US006761225B2

(12) United States Patent
Climent

(10) Patent No.: US 6,761,225 B2
(45) Date of Patent: Jul. 13, 2004

(54) SECURITY DISPOSITION AGAINST FIRE APPLICABLE FOR DELAYING, RETAINING, CONTROLLING AND EXTINGUISHING THE ACTION OF FIRE BY MEANS OF MOISTURE, WITH WATER AS ITS BASIC EXTINGUISHING ELEMENT

(75) Inventor: Salvador Mateu Climent, Valencia (ES)

(73) Assignee: Thertim, S.L., Valencia (ES)

( * ) Notice: Subject to any disclaimer, the term of this patent is extended or adjusted under 35 U.S.C. 154(b) by 193 days.

(21) Appl. No.: 10/039,180

(22) Filed: Jan. 8, 2002

(65) Prior Publication Data

US 2003/0127233 A1 Jul. 10, 2003

(51) Int. Cl.[7] ..... A62C 35/00

(52) U.S. Cl. ..... 169/16; 169/18; 169/5; 239/208

(58) Field of Search ..... 169/5, 16, 44, 169/45, 46, 60, 61, 18; 239/208

(56) References Cited

U.S. PATENT DOCUMENTS 4,330,040 A * 5/1982 Ence et al. ..... 169/16
5,379,610 A * 1/1995 Sakurai et al. ..... 169/16
5,564,505 A * 10/1996 Moliere ..... 169/16
6,044,911 A * 4/2000 Haase, III ..... 169/16
6,158,519 A * 12/2000 Kretschmer ..... 169/16

* cited by examiner

*Primary Examiner*—Dinh Q. Nguyen
(74) *Attorney, Agent, or Firm*—Harrison & Egbert

(57) ABSTRACT

A security disposition against fire applicable for delaying, retaining, controlling and extinguishing the action of fire by means of moisture, with water as its basic extinguishing element. It consists of a part that is made of metal or any other material with identical resistance, upon which water distribution pipes are placed, and is equipped with distributors that have access to the partition or similar construction. The distribution pipes are joined by connecting piping, which at the same time is connected to a supply pipe. On the connecting piping, between the supply pipe and the distribution pipes, is an open/close electrovalve that is activated by conventional fire detecting methods, temperature or smoke, in addition to a purge valve that is activated manually.

6 Claims, 2 Drawing Sheets

SECURITY DISPOSITION AGAINST FIRE APPLICABLE FOR DELAYING, RETAINING, CONTROLLING AND EXTINGUISHING THE ACTION OF FIRE BY MEANS OF MOISTURE, WITH WATER AS ITS BASIC EXTINGUISHING ELEMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention finds its application in the field of the industry devoted to extinguishing fires.

BACKGROUND OF THE INVENTION

Water is the extinguishing agent par excellence: it is the cheapest, the most abundant, and the most widely used in extinguishing fires.

Man has always used water for this purpose, and it can be affirmed that practically everyone knows how to use this element to suppress a fire.

The great extinguishing capacity of water is determined by a series of physical and chemical characteristics that make it irreplaceable, amongst which are the following:

- Stability, since water is a very stable compound that separates into its elements at around 1,200° C.;
- Specific heat, stated as 1 cal/gram per centigrade;
- Latent heat of vaporization, since 540 calories are required for one gram of water to reach 100° C., that is to say water vapor at 100° C.; and
- Expansion on vaporizing, since each gram of water increases its volume approximately 1,700 times on vaporizing, and consequently each liter of water becomes approximately 1,700 liters of water vapor.

Due to these characteristics, water acts as an extinguishing agent mainly through cooling and suffocation.

Given the high specific heat of each gram of water, in order to raise the temperature by one degree, 1 calorie is absorbed. On the other hand, given its high latent heat of vaporization, each gram of water absorbs more heat to become water vapor.

These two characteristics give it a high refrigerating power, with the result that water "takes out" a large quantity of heat from the fire and the materials cool. Consequently, it is possible to reduce the temperature of the materials involved in the fire, lowering it to below their ignition point.

Suffocation is achieved by displacing the air that surrounds the fire. When water becomes vapor, and in accordance with an increase in its volume, it manages to displace hot gases and even air, and as there is no oxygen the fire is extinguished by suffocation.

In certain circumstances, water also acts by dissolving the combustible liquids and lowering their concentration to extreme limits, giving the vapor-combustible-air mixture a concentration less than that at the point of ignition.

It is clear that water has an enormous extinguishing capacity with the result that, although we do not exactly know the reason, we intuitively know that water is the best element to extinguish a fire, although this depends to a large extent on the techniques employed.

The applicant is aware of the existence and utilization at present of valves that are joined to a network of water pipes, and that have temperature detecting elements, so that once the limits established are exceeded the valve in question opens, and a stream of micro drops of water falls vertically downwards in order to suppress the fire within the room or rooms where the emission valves have been fitted into the ceiling.

Nevertheless, until now, the applicant does not know of the existence of a security disposition against fire which, by using water as a basic extinguishing component, allows partitions or walls, floors or floor coverings, and ceilings to be built from materials with a high hygroscopic and capillary value, without these materials losing their physical and mechanical qualities, and dampening the partitions or walls, floors or floor coverings, and ceilings, in an anticipated and controlled manner. This control makes it possible to avoid, to a large extent, one of the greatest inconveniences of extinguishing a fire with water when it is used indiscriminately and in large quantities, such as the damage caused to recuperated goods, as well as damage to the installations or items of great value.

BRIEF SUMMARY OF THE INVENTION

The following description refers to an application for the patent of an invention, regarding a security disposition against fire applicable for delaying, retaining, controlling and extinguishing the action of fire by means of moisture, with water (which may contain additives or not) as its basic extinguishing element. The function of dampening partitions or walls, floors or floor coverings, and ceilings with water, is carried out by means of a water sprinkler system, which takes account of spraying, misting, exudation and similar processes. At the same time the invention takes advantage of the property of some inorganic materials and all organic materials, both natural and artificial, to absorb and emit humidity according to the surrounding circumstances, a property that is known as being hygroscopic. The invention also takes advantage of the capillarity or property of solid bodies to attract and draw up their walls, to a certain extent, the liquid that dampens them, such as the case of the water employed in this invention.

The invention also takes into account the fact that its stability, resistance and insulating property must not be reduced in the presence of fire, in addition to avoiding the emission of toxic or flammable gases, and the fact that it may be installed in any type of construction with a maximum degree of individualization, both in a building and mobile structure such as a boat.

The security disposition against fire applicable for delaying, retaining, controlling and extinguishing the action of fire by means of moisture, with water as its basic extinguishing element as proposed by the invention, constitutes per se an evident novelty in the field of application in which it is incorporated, by bringing together in a general context numerous advantages that are not taken into account by fire fighting systems that use water as a basic element to suppress fire, by preserving the structures and items found in the surrounding area and causing practically no damage to them.

The security disposition against fire applicable for delaying, retaining, controlling and extinguishing the action of fire by means of moisture, with water as its basic extinguishing element, uses a "U" shaped metal ring that embraces the partition or wall of the enclosure. The partition has a wooden central core with two plaster panels situated on either side of the wooden core, in addition to two panels of agglomerate on the adjacent sides of the plaster panels, with a supply pipe that is connected to two distribution pipes which, by means of distributors, injects water into the plaster panels. Said plaster panels, which are prepared beforehand to rapidly absorb water, activate the security disposition by means of an automatic system composing of one or several electrovalves that open and close, depending on requirements, using computerized methods to obtain the correct size of the opening and appropriate degree of pressure, as well as a manual purge valve as a means of security, which permits the state of the installation to be checked periodically.

It must be reiterated that it is possible to add additives to the water or not, as the case may be.

These partitions or walls, floors and floor coverings, and ceilings, can also be built from natural or artificial materials whose properties are similar to those of wood and plaster.

In essence, the security disposition against fire consists of fighting fires from the very beginning by using partitions or walls, floors or floor coverings, and ceilings that make up the enclosure, made from materials with a high hygroscopic and capillary power, in order to dampen these materials in an anticipated and controlled manner by means of water sprinkler methods using artificial pressure, such as spraying, misting, exudation, etc., until the ideal degree of moisture is reached, which is usually when fibers are saturated.

As a complement of the invention, the use of all types of fire detectors has been envisaged, amongst which smoke optics are employed by means of photographic cameras or video images that measure the luminosity and darkness of the enclosure protected by the invention, and at the same time detect smoke particles with a laser.

BRIEF DESCRIPTION OF THE SEVERAL VIEWS OF THE DRAWINGS

In order to complement this description and to aid a better understanding of the characteristics of the invention, four sheets of plans accompany this description for purely illustrative and not limiting purposes.

DETAILED DESCRIPTION OF THE INVENTION

Figure 1:
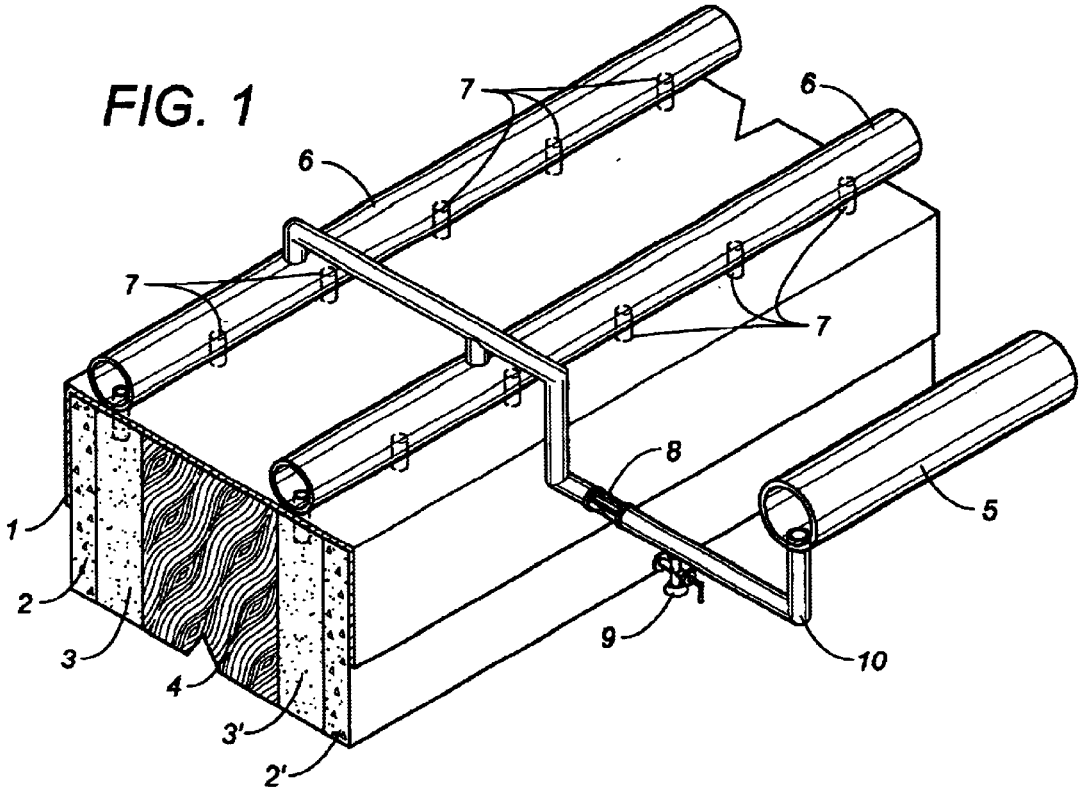
FIG. 1 shows a perspective view of the object of the invention, regarding the security disposition against fire applicable for delaying, retaining, controlling and extinguishing the action of fire by means of moisture, with water as its basic extinguishing element.

From the figures, and specifically FIG. 1, it can be seen how the security disposition against fire applicable for delaying, retaining, controlling and extinguishing the action of fire by means of moisture, with water as its basic extinguishing element, is constituted starting from outside walls, floors, ceilings, inside walls, etc., made from wood (4) with an outer layer of plaster (3) and (3'), while the plaster is covered by an agglomerate sheet (2) and (2'), more specifically an agglomerate derived from wood.

A metal part or bracket (1) with an inverted "U" shape can be found in the upper part of the five adjoining elements. On top of this metal part are the water distribution pipes (6) with outlets or distributors (7), through which the water (whether mixed with other products or not) comes out, dampening parts (2), (2'), (3), (3') and (4) that are fixed by the aforementioned metal bracket (1).

With the aim of obtaining an adequate flow of water through the distribution pipes (6), some piping (10) connects the supply pipe (5) to the distribution pipes (6). In a straight section of the pipe (10), an open/close electrovalve (8) that is activated automatically, and a manual purge valve (9), have been incorporated.

Figure 2:
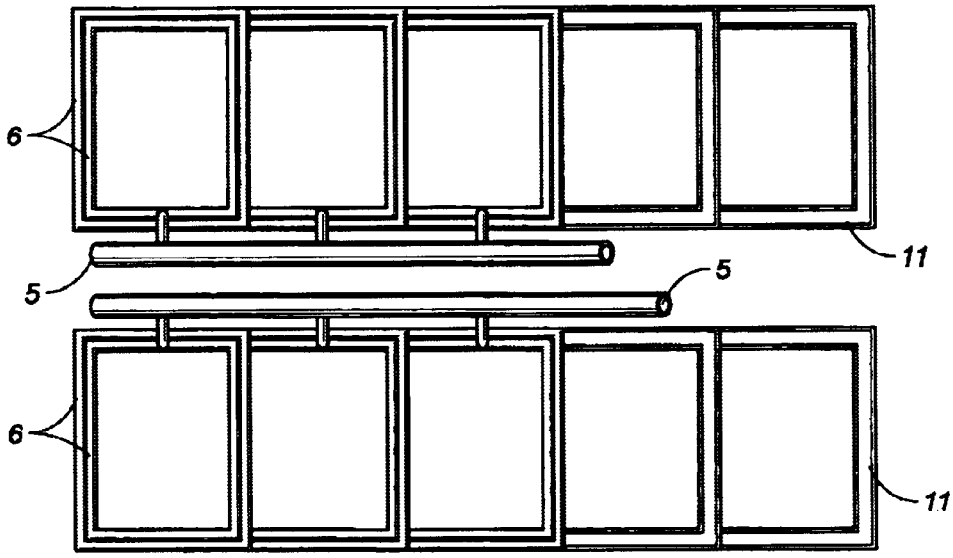
FIG. 2 shows a plan view of the distribution of the water sprinkler system including the supply pipe, distribution pipes and partition or wall to be dampened.

FIG. 2 shows a plan view of the installation, referring to (11) the group of elements made up by the partition, wall, ceiling or similar structure that is to be dampened by the security disposition. Once a source of fire has been detected, the open/close electrovalve is activated, letting water pass through the piping (10) from the pipes (5) to the distribution and injection pipes (6), in such a way that the water flowing through the distribution and injection pipes (6) gradually comes out through the distributors or injectors directed at this group of elements (11).

Figure 3:
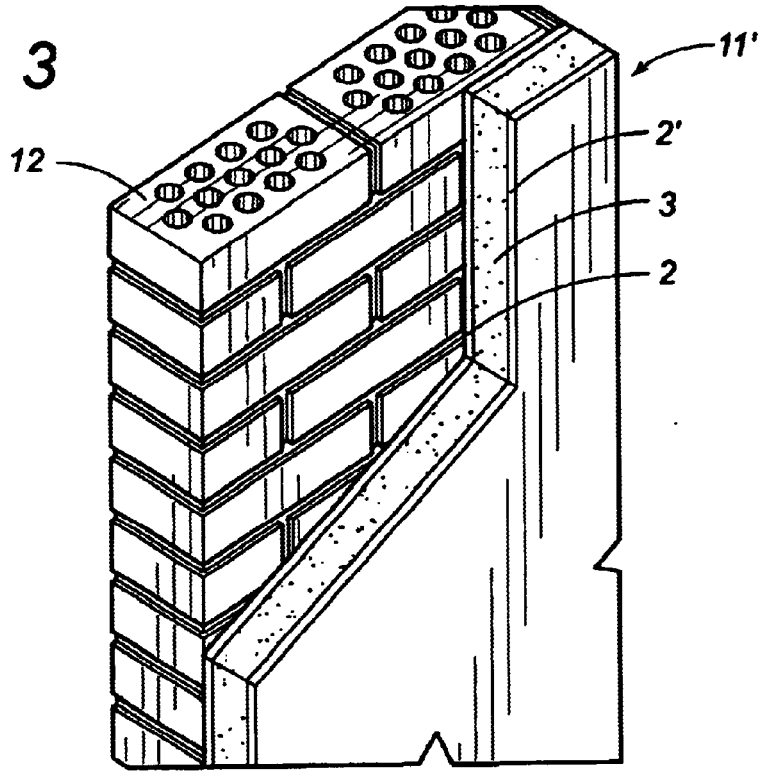
FIG. 3 corresponds to a perspective view of the invention, with the aim to protect on one side the base structure of a building such as a brick wall, to which a protective layer is added.
Figure 4:
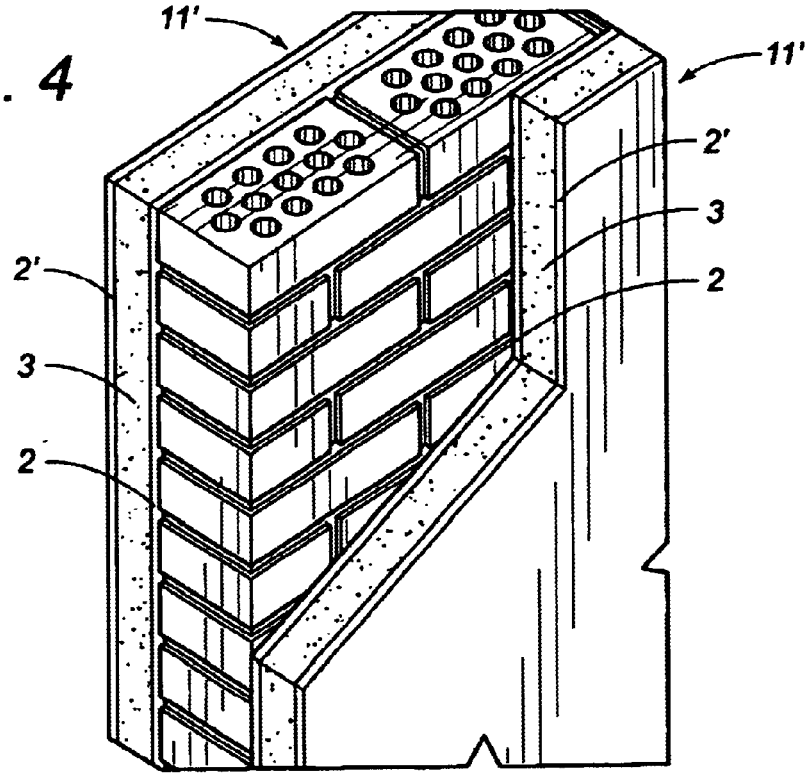
FIG. 4 shows a similar perspective view of the object represented in FIG. 3, protecting a brick structure on two sides.

In FIG. 3, it can be seen how a brick wall (12) of a load-bearing structure or a similar structure, can be protected by an outer layer formed by a plaster core (3) that is covered by layers of agglomerate or any other wood by-product (2) and (2'), forming a general covering (11') that can be placed on one or two sides of the wall (12) as shown in FIG. 4.

A more extensive description is not considered necessary for any expert in the subject to be able to comprehend the scope of the invention and the advantages that may be derived from it.

The materials, shape, size and the arrangement of the parts will be subject to variation providing that this does not imply an alteration to the essence of the invention.

The terminology used in this description should be taken in its widest and non-limiting meaning.

I claim:

1. A system for protection of a building against fire by delaying, retaining, controlling and extinguishing the action of fire through the use of water, the system comprising:

a panel of the building;

a layer of plaster applied to at least one surface of said panel;

an agglomerate material applied to a surface of said layer of plaster opposite said panel;

a bracket member secured over said panel and said layer of plaster and said agglomerate material;

a plurality of distributors extending through said bracket so as to communicate with said layer of plaster;

a plurality of distribution pipes connected to and communicating with said plurality of distributors;

a supply pipe connected to said plurality of distribution pipes by connection piping;

a valving means affixed to said connection piping, said valve means movable between an open position and a closed position, said valving means for moving from said closed position to said open position when the fire is detected so as to allow the water to pass from said supply pipe into said plurality of distribution pipes and into said plurality of distributors and into said layer of plaster; and a purge valve connected to said connection pipe, said purge valve being manually activatable.

2. The system claim 1, said panel being selected from the group consisting of an outside wall, an inside wall, a floor and a ceiling.

3. The system of claim 1, said panel being of material selected from the group consisting of wood and brick.

4. The system of claim 1, said layer of plaster being a first layer of plaster applied to one surface of said panel and a second layer of plaster applied to an opposite surface of said panel, said agglomerate material being applied to a surface of said first layer of plaster opposite panel, said agglomerate material applied to a surface of said second layer of plaster opposite said panel.

5. The system of claim 1, said agglomerate material being a wood by-product.

6. The system of claim 1, said bracket being of a metal material.

* * * * *